US006114017A

United States Patent [19]

Fabbricante et al.

[11] Patent Number: 6,114,017

[45] Date of Patent: Sep. 5, 2000

[54] MICRO-DENIER NONWOVEN MATERIALS MADE USING MODULAR DIE UNITS

[76] Inventors: Anthony S. Fabbricante, 19 Hill Dr., Oyster Bay, N.Y. 11771; Gregory F. Ward, 11115 Rotherick Dr., Alpharetta, Ga. 30022; Thomas J. Fabbricante, 75 Inwood Rd., Port Washington, N.Y. 11050

[21] Appl. No.: 08/899,125

[22] Filed: Jul. 23, 1997

[51] Int. Cl.[7] ..... B32B 27/14; D04H 3/16

[52] U.S. Cl. ..... 428/198; 428/219; 156/167

[58] Field of Search ..... 156/167; 428/198, 428/219

[56] References Cited

U.S. PATENT DOCUMENTS 4,375,718 3/1983 Wadsworth et al. ..... 29/592 E 5,232,770 8/1993 Joseph ..... 428/284

*Primary Examiner*—Christopher Raimund

[57] ABSTRACT

A series of nonwoven webs and the processes for their production are disclosed. The resultant webs have equal or superior strength characteristics to conventional nonwoven fabrics made using spunbond processes but their constituent fibers are of a finer diameter. This is accomplished through a process of melt blowing a nonwoven fabric made from at least one polymer at low polymer flows per die hole and low air and polymer pressures using modular die technology to provide a die with one or more rows of die holes. The nonwoven fabric of this invention may be used in products such as diapers, feminine hygiene products, filters, progressive layer filters, adult incontinence products, wound dressings, bandages, sterilization wraps, surgical drapes, geotextiles, wipers, insulation and other related products.

19 Claims, 2 Drawing Sheets

MICRO-DENIER NONWOVEN MATERIALS MADE USING MODULAR DIE UNITS

FIELD OF THE INVENTION

The present invention relates to micro-denier nonwoven webs and their method of production using modular die units in an extrusion and blowing process.

DESCRIPTION OF THE PRIOR ART

Thermoplastic resins have been extruded to form fibers and webs for many years. The nonwoven webs so produced are commercially useful for many applications including diapers, feminine hygiene products, medical and protective garments, filters, geotextiles and the like.

A highly desirable characteristic of the fibers used to make nonwoven webs for certain applications is that they be as fine as possible. Fibers with small diameters, less than 10 microns, result in improved coverage and higher opacity. Small diameter fibers are also desirable since they permit the use of lower basis weights or grams per square meter of nonwoven. Lower basis weight, in turn, reduces the cost of products made from nonwovens. In filtration applications small diameter fibers create correspondingly small pores which increase the filtration efficiency of the nonwoven The most common of the polymer-to-nonwoven processes are the spunbond and meltblown processes. They are well known in the US and throughout the world. There are some common general principles between melt blown and spunbond processes. The most significant are the use of thermoplastic polymers extruded at high temperature through small orifices to form filaments and using air to elongate the filaments and transport them to a moving collector screen where the fibers are coalesced into a fibrous web or nonwoven.

In the typical spunbond process the fiber is substantially continuous in length and has a fiber diameter typically in the range of 20 to 80 microns. The meltblown process, on the other hand, typically produces short, discontinuous fibers that have a fiber diameter of 2 to 6 microns.

Commercial meltblown processes, as taught by U.S. Pat. No. 3,849,241 to Buntin, et al, use polymer flows of 1 to 3 grams per hole per minute at extrusion pressures from 400 to 1000 psig and heated high velocity air streams developed from an air pressure source of 60 or more psig to elongate and fragment the extruded fiber. This process also reduces the fiber diameter by a factor of 190 (diameter of the die hole divided by the average diameter of the finished fiber) compared to a diameter reduction factor of 30 in spunbond processes. The typical meltblown die directs air flow from two opposed nozzles situated adjacent to the orifice such that they meet at an acute angle at a fixed distance below the polymer orifice exit. Depending on the air pressure and velocity and the polymer flow rate the resultant fibers can be discontinuous or substantially continuous. In practice, however, the continuous fibers made using accepted meltblown art and commercial practice are large diameter, weak and have no technical advantage. Consequently the fibers in commercial meltblown webs are fine (2–10 microns in diameter) and short, typically being less than 0.5 inches in length.

It is well known in the nonwoven industry that, in order to be competitive in melt blowing polymers, from both an equipment and a product standpoint, polymer flows per hole must be at least 1 gram per minute per hole as disclosed by U.S. Pat. No. 5,271,883 to Timmons et al. If this is not the case additional dies or beams are required to produce nonwovens at a commercially acceptable rate. Since the body containing the die tips and the die tips themselves as used in standard commercial melt blowing die systems are very expensive to produce, multiple die bodies make low polymer and low air flow systems unworkable from an operational and an economic viewpoint. It is additionally recognized that the high air velocities coupled with the very large volumes of air created in a typical meltblown system creates considerable turbulence around the collector. This turbulence prevents the use of multiple rows of die holes especially if for technical or product reasons the collector is very close to the die holes. Additionally, the extremely high cost of machining makes multiple rows of die holes enclosed in a single die body cost prohibitive. Presently the art of blowing or drawing fibers, composed of the various thermally extrudable organic and inorganic materials, is limited to the use of subsonic air flows although the achievement of supersonic flows would be advantageous in certain meltblown and spunbond applications. It is well known from fluid dynamics, however, that in order to develop supersonic flows in compressible fluids, such as air, a specially designed convergent-divergent nozzle must be used. However, it is virtually impossible to provide the correct convergent-divergent profile for a nozzle by machining a monolithic die especially when large numbers of nozzles are required in a small space.

SUMMARY OF THE INVENTION

The instant invention is a new method of making nonwoven webs, mats or fleeces wherein a multiplicity of filaments are extruded at low flows per hole from a single modular die body or a series of modular die bodies wherein each die body contains one or more rows of die tips. The modular construction permits each die hole to be flanked by up to eight air jets depending on the component plate design of the modular die.

The air used in the instant invention to elongate the filaments is significantly lower in pressure and volume than presently used in commercial applications. The instant invention is based on the surprising discovery that using the modular die design, in a melt blowing configuration at low air pressure and low polymer flows per hole, continuous fibers of extremely uniform size distribution are created, which fibers and their resultant unbonded webs exhibit significant strength compared to typical unbonded meltblown or spunbond webs. In addition substantial self bonding is created in the webs of the instant invention. Further, it is also possible to create discontinuous fibers as fine as 0.1 microns by using converging-diverging supersonic nozzles.

For purposes of defining the air flow characteristics of the instant invention the term "blowing" is assumed to include blowing, drafting and drawing. In the typical spunbond system the only forces available to elongate the fiber as it emerges from the die hole is the drafting or drawing air. This flow is parallel to the fiber path. In the typical meltblown system the forces used to elongate the fiber are directed at an oblique angle incident to the surface. The instant invention uses air to produce fiber elongation by forces both parallel to the fiber path and incident to the fiber path depending on the desired end result.

Accordingly, it is an object of the present invention to produce a unique nonwoven web using the modular extrusion die apparatus described in the U.S. application Ser. No. 08/370,383 by Fabbricante, et al now U.S. Pat. No. 5,679,379, whereby specially shaped plates are combined in a repeating series to create a sequence of readily and economically manufactured modular die units which are then contained in a die housing which is a frame or holding device that contains the modular plate structure and accommodates the design of the molten polymer and heated air inlets. The cost of a die produced from that invention is approximately 10 to 20% of the cost of an equivalent die produced by traditional machining of a monolithic block. It is also critical to note that it is virtually impossible to machine a die having multiple rows of die holes and multiple rows of air jets.

Because of the modular die invention and its inherent economies of manufacture it is possible for multiple rows of die holes and multiple die bodies to be used without high capital costs. This in turn permits low flows per hole with concomitant ability to use low melt pressures for fiber extrusion and low air pressures for elongating these filaments. As an example, in an experimental meltblown die configuration, flows of less than 0.1 grams per hole per minute and using heated air at 5 psig pressure create a strong self bonded web of 2 micron fibers. The web may also be thermally bonded to provide even greater strength by using conventional hot calendering techniques where the calender rolls may pattern engraved or flat.

Another unexpected result is that because of the low pressure air and low flow volumes, even though the die bodies contains multiple rows of die tips, there is virtually no resultant turbulence that would create fiber entanglement and create processing problems.

A further unforeseen result of the instant invention is that the combination of multiple rows of die holes with multiple offset air jets all running at low polymer and air pressure do not create polymer and air pressure balancing problems within the die. Consequently the fiber diameter, fiber extrusion characteristics and web appearance are extremely uniform.

A further invention is that the web produced has characteristics of a meltblown material such as very fine fibers (from 0.6 to 8 micron diameter), small inter-fiber pores, high opacity and self bonding, but surprisingly it also has characteristics of a spunbond material such as substantially continuous fibers and high strength when bonded using a hot calender A further invention is that when a die using a series of converging-diverging nozzles, either in discrete air jets or continuous slots which are capable of producing supersonic drawing velocities, wherein the flow of the nozzles is parallel to the centerline of the die holes, which die holes have a diameter greater than 0.015 inches, the web produced without the use of a quench air stream has fine fibers (from 5 to 20 microns in diameter dependent on die hole size, polymer flow rates and air pressures), small inter-fiber pores, good opacity and self bonding but, surprisingly, it has characteristics of a spunbond material such as substantially continuous fibers and high strength when bonded using hot calender. It is important to note that a quench stream can easily be incorporated within the die configuration if required by specific product requirements.

A further invention is that when a die using a series of converging-diverging nozzles, which are capable of producing supersonic drawing velocities, wherein the angle formed between the axis of the die holes and supersonic air nozzles varies between 0° and 60°, and which die holes have a diameter greater than 0.005 inches, the web produced has fine fibers (from 0.1 to 2 microns in diameter dependent on die hole size, polymer flow rates and air pressures), extremely small inter-fiber pores, good opacity and self bonding.

DESCRIPTION OF THE INVENTION

The present invention is a novel method for the extrusion of substantially continuous filaments and fibers using low polymer flows per die hole and low air pressure resulting in a novel nonwoven web or fleece having low average fiber diameters, improved uniformity, a narrow range of fiber diameters, and significantly higher unbonded strength than a typical meltblown web. When the material is thermally point bonded it is similar in strength to spunbonded nonwovens of the same polymer and basis weight. This permits the manufacture of commercially useful webs having a basis weight of less than 12 grams/square meter.

Another important feature of the webs produced are their excellent liquid barrier properties which permit the application of over 50 cm of water pressure to the webs without liquid penetration.

Another feature of the present invention is that the modular die units may be mixed within one die housing thus simultaneously forming different fiber diameters and configurations which are extruded simultaneously, and when accumulated on a collector screen or drum provide a web wherein the fiber diameters can be made to vary along the Z axis or thickness of the web (machine direction being the X axis and cross machine direction being the Y axis) based on the diameters of the die holes in the machine direction of the die body.

Yet another feature of the present invention is that multiple extrudable materials may be utilized simultaneously within the same extrusion die by designing multiple polymer inlet systems.

Still another feature of the present invention is that since multiple extrudable molten thermoplastic resins and multiple extrusion die configurations may be used within one extrusion die housing, it is possible to have both fibers of different material and different fiber diameters or configurations extruded from the die housing simultaneously.

The novel features which are considered characteristic for the invention are set forth in particular in the appended claims. The invention itself, however, both as to its construction and its method of operation, together with additional objects and advantages thereof, will be best understood from the following description of the specific embodiments when read in connection with the accompanying drawings.

It will be understood that each of the elements described above, or two or more together, may also find a useful application in other types of constructions differing from the type described above including but not limited to webs derived from thermoplastic polymers, thermoelastic polymers, glass, steel, and other extrudable materials capable of forming fine fibers of commercial and technical value.

BRIEF DESCRIPTION OF THE DRAWINGS

These features as well as others, shall become readily apparent after reading the following description in conjunction with the accompanying drawings in which.

DETAILED DESCRIPTION OF SOME OF THE PREFERRED EMBODIMENTS

The melt blown process typically uses an extruder to heat and melt the thermopolymer. The molten polymer then passes through a metering pump that supplies the polymer to the die system where it is fiberized by passage through small openings in the die called, variously, die holes, spinneret, or die nozzles. The exiting fiber is elongated and its diameter is decreased by the action of high temperature blowing air. Because of the very high velocities in standard commercial meltblowing the fibers are fractured during the elongation process. The result is a web or mat of short fibers that have a diameter in the 2 to 10 micron range depending on the other process variables such as hole size, air temperature and polymer characteristics including melt flow, molecular weight distribution and polymeric species.

Figure 1:
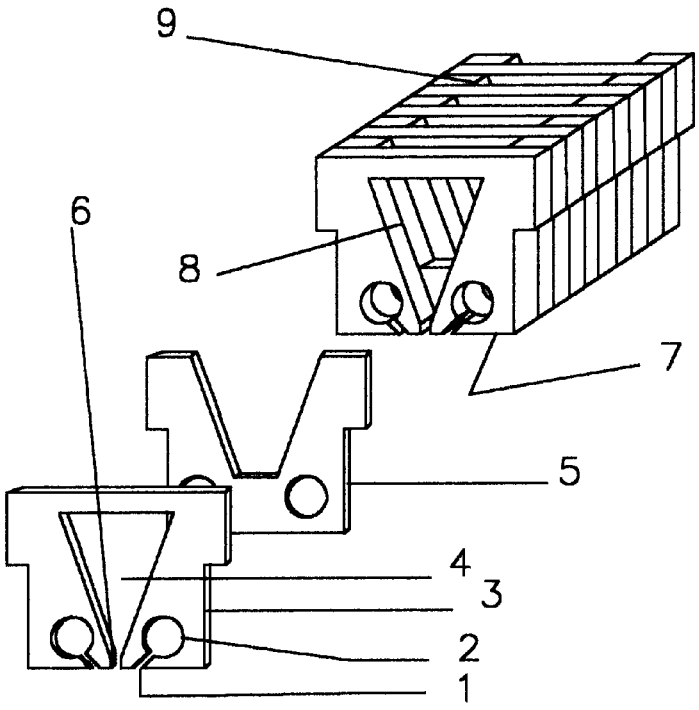
FIG. 1 is a sectional view illustrating the primary plate and secondary plate that illustrates the arrangement of the various feed slots where there is both a molten thermoplastic resin flow and an air flow through the modular die and both the polymer die hole and the air jet are contained in the primary plate.

Referring to FIG. 1 of the drawings a modular die plate assembly 7 is formed by the alternate juxtaposition of primary die plates 3 and secondary die plates 5 in a continuing sequence. A fiber forming, molten thermoplastic resin is forced under pressure into the slot 9 formed by secondary die plate 5 and primary die plate 3 and secondary die plate 5. The molten thermoplastic resin, still under pressure, is then free to spread uniformly across the lateral cavity 8 formed by the alternate juxtaposition of primary die plates 3 and secondary die plates 5 in a continuing sequence. The molten thermoplastic resin is then extruded through the orifice 6, formed by the juxtaposition of the secondary plates on either side of primary plate 3, forming a fiber. The size of the orifice that is formed by the plate juxtaposition is a function of the width of the die slot 6 and the thickness of the primary plate 3. The primary plate 3 in this case is used to provide two air jets 1 adjacent to the die hole. It should be recognized that the secondary plate can also be used to provide two additional air jets adjacent to the die hole.

The angle formed between the axis of the die hole and the air jet slot that forms the air nozzle or orifice 6 can vary between 0° and 60° although in this embodiment a 30° angle is preferred. In some cases there may be a requirement that the exit hole be flared.

Figure 2:
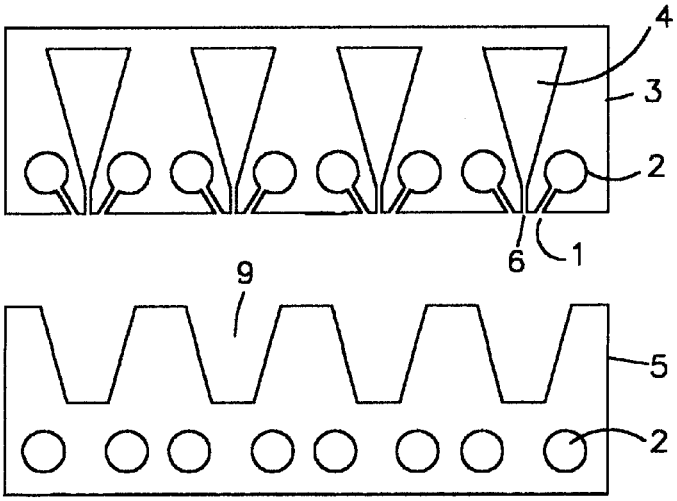
FIG. 2 shows how primary and secondary die plates in the modular plate construction can be used to provide 4 rows of die holes and the required air jet nozzles for each die hole.

Referring to FIG. 2 this shows how the modular primary and secondary die plates are designed to include four rows of die holes and air jets. The plates are assembled into a die in the same manner as shown in FIG. 1.

Figure 3:
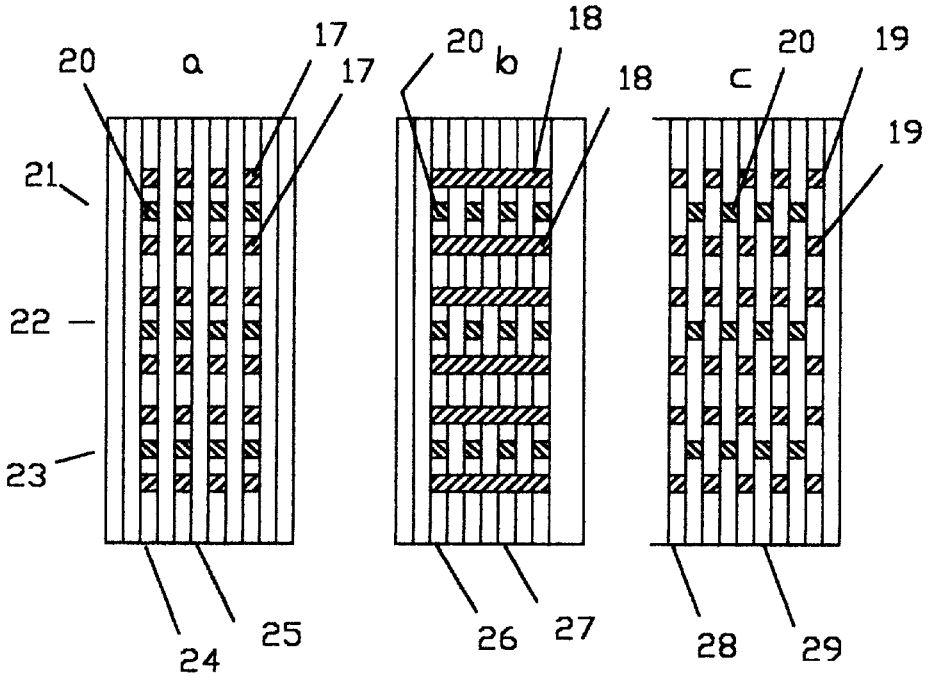
FIG. 3 is a plan view of three variations on the placement of die holes and their respective air jet nozzles in a die body with 3 rows of die holes in the cross-machine direction.

Referring to FIG. 3 we see a plan view of the placement of die holes and air jet nozzles in three different die bodies FIGS. 3*a*, 3*b* and 3*c* each with 3 rows 21, 22, 23 of die holes and air jets in the machine direction of the die. The result is a matrix of air nozzles and melt orifices where their separation and orientation is a function of the plate and slot design and primary and secondary plate(s) thickness. FIG. 3*a* shows a system wherein the die holes 20 and the air jets 17 are located in the primary plate 24 with the secondary plate 25 containing only the polymer and air passages. In this embodiment each die hole along the width of the die assembly has eight air jets immediately adjacent to it. Two jets in each primary plate impinge directly upon the fiber exiting the die hole while the other six assist in drawing the fiber with an adjacent flow.

FIG. 3*b* shows a system wherein the die holes 20 are located only in the primary plate and the air jets are located in both the primary 26 and secondary plates 27 thereby creating a continuous air slot 18 on either side of the row of die holes.

FIG. 3*c* shows a system wherein the die holes 20 are located only in the primary plate 28 and the air jets are located in the secondary plates 29 thereby creating airjets 19 on either side of the row of die holes. This adjacent flow draws without impinging directly on the fiber and assists in preserving the continuity of the fiber without breaking it. This configuration provides four air jets per die hole.

While it is not shown, it is clear from the above that a juxtaposed series of only primary plates would provide a slit die that could be used for film forming.

Consequently the instant invention presents the ability to extend the air and melt nozzle matrix a virtually unlimited distance in the lateral and axial directions. It will be apparent to one versed in the art how to provide the polymer and air inlet systems to best accommodate the particular system being constructed. The modular die construction in this particular embodiment provides a total of 4 air nozzles for blowing adjacent to each die hole although it is possible to incorporate up to 8 nozzles adjacent to each die hole. The air, which may be at temperatures of up to 900° F., provides a frictional drag on the fiber and attenuates it. The degree of attenuation and reduction in fiber diameter is dependent on the melt temperature, die pressure, air pressure, air temperature and the distance from the die hole exit to the surface of the collector screen.

It is well known in the art that very high air velocities will elongate fibers to a greater degree than lower velocities. Fluid dynamics considerations limit slot produced air velocities to sonic velocity. Although it is known how to produce supersonic flows with convergent-divergent nozzles this has not been successfully accomplished in meltblown or spunbond technology. It is believed that this is due to the considerable difficulty or impossibility of producing a large number of convergent-divergent nozzles in a small space in conventional monolithic die manufacturing.

Figure 4:
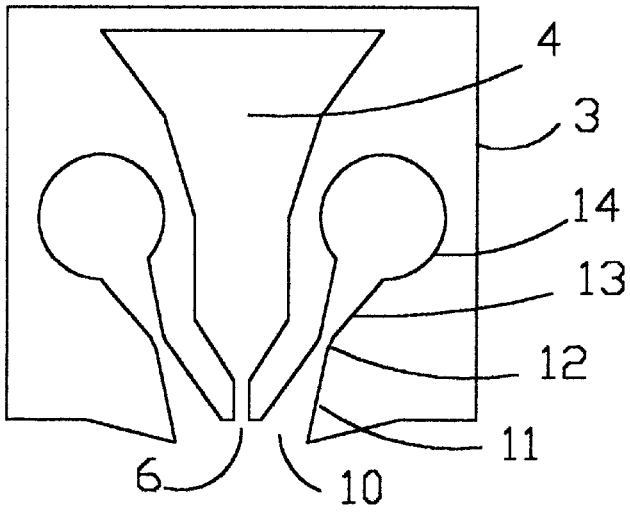
FIG. 4 illustrates the incorporation of a converging-diverging supersonic nozzle in a primary modular die plate for the production of supersonic air or other fluid flows.

FIG. 4 illustrates how this can be accomplished within the modular die plate configuration. Only a primary plate 3 is shown. In practice the secondary plate would be similar to that shown in FIG. 1. The primary plate contains a die hole 6 and two converging-diverging nozzles. FIG. 4 shows how the lateral air passage 14 provides pressurized air to the converging duct section 13 which ends in a short orifice section 12 connected to the diverging duct section 11 and provides, in this case, two incident supersonic flows impinging on the fiber exiting the die hole. This arrangement provides very high drafting and breaking forces resulting in very fine (less than 1 micron diameter) short fibers.

This general method of using modular dies to create a multiplicity of convergent-divergent nozzles can also be used to create a supersonic flow within a conventional slot draw system as currently used in spunbond by using an arrangement wherein the converging-diverging nozzles are parallel to the die hole axis rather than inclined as shown in FIG. 4. An alternative to the two air nozzles per die hole arrangement is to use the nozzle arrangement of FIG. 3*b* wherein the primary and secondary plates all contain converging-diverging nozzles resulting in a continuous slot converging-diverging nozzle.

In the typical meltblown application the extrusion pressure is between 400 and 1000 pounds per square inch. This pressure causes the polymer to expand when leaving the die hole because of the recoverable elastic shear strain peculiar to viscoelastic fluids. The higher the pressure, the greater the die swell phenomena. Consequently at high pressures the starting diameter of the extrudate is up to 25% larger than the die hole diameter making fiber diameter reduction more difficult. In the instant embodiment the melt pressure typically ranges from 20 to 200 psig. The specific pressure depends on the desired properties of the resultant web. Lower pressures result in less die swell which assists in further reduction of finished fiber diameters.

The attenuated fibers are collected on a collection device consisting of a porous cylinder or a continuous screen. The surface speed of the collector device is variable so that the basis weight of the product web can increased or decreased. It is desirable to provide a negative pressure region on the down stream side of the cylinder or screen in order to dissipate the blowing air and prevent cross currents and turbulence.

The modular design permits the incorporation of a quench air flow at the die in a case where surface hardening of the fiber is desirable. In some applications there may be a need for a quench air flow on the fibers collected on the collector screen.

Ideally the distance from the die hole outlet to the surface of the collector should be easily varied. In practice the distance generally ranges from 3 to 36 inches. The exact dimension depends on the melt temperature, die pressure, air pressure and air temperature as well as the preferred characteristics of the resultant fibers and web.

The resultant fibrous web may exhibit considerable self bonding. This is dependent on the specific forming conditions. If additional bonding is required the web may be bonded using a heated calender with smooth calender rolls or point bonding.

The method of the invention may also be used to form an insulating material by varying the distance of the collector means from the die resulting in a low density web of self-bonded fibers with excellent resiliency after compression.

The fabric of this invention may be used in a single layer embodiment or as a multi-layer laminate wherein the layers are composed of any combination of the products of the instant invention plus films, woven fabrics, metallic foils, unbonded webs, cellulose fibers, paper webs both bonded and debonded, various other nonwovens and similar planar webs suitable for laminating. Laminates may be formed by hot melt bonding, needle punching, thermal calendering and any other method known in the art. The laminate may also be made in-situ wherein a spunbond web is applied to one or both sides of the fabric of this invention and the layers are bonded by point bonding using a thermal calender or any other method known in the art.

EXAMPLES

Several self bonded nonwoven webs were made from a meltblowing grade of Philips, 35 melt flow polypropylene resin using a modular die containing a single row of die holes. The length of a side of the square spinneret holes was 0.015 inches and the flow per hole varied from 0.05 to 0.1 grams/hole/minute at 150 psig. Air pressure of the heated air flow was varied from 4 to10 psig. Fiber diameter, web strength and hydrostatic head (inches of water head) were measured. The fibers were collected on a collector cylinder capable of variable surface speed.

TABLE 1

| Trial Run | Air Pressure | Flow Rate | Basis Wt | Microns | H2O head | Break Load |
|---|---|---|---|---|---|---|
| 1 | 4 | 0.05 | 10.3 | 2.7 | 20 | 241 |
| 2 | 4 | 0.10 | 17.8 | 2.9 | >30 | 456 |
| 3 | 6 | 0.05 | 11.7 | 2.2 | >30 | 299 |
| 4 | 6 | 0.10 | 16.5 | 2.7 | >30 | 423 |
| 5 | 10 | 0.05 | 12.1 | 1.9 | >30 | 270 |

The results shown in Table 1 show that the method of the invention unexpectedly produced a novel web state with significant self bonding with surprising strength in the unbonded and with excellent liquid barrier properties.

In another example several self bonded nonwoven webs of were made from a meltblowing grade of Philips polypropylene resin using a die with three rows of die holes across the width of the die. The length of a side of the square spinneret holes was 0.015 inches and the flow per hole varied from 0.05 to 0.1 grams/hole/minute at 150 psig. Air pressure of the heated air flow was varied from 4 to 10 psig. The fibers were collected on a collector cylinder capable of variable surface speed. Fiber diameter, web strength and hydrostatic head (inches of water head) were measured.

TABLE 2

| Trial Run | Air Pressure | Flow Rate | Basis Wt | Microns | H2O head | Break Load |
|---|---|---|---|---|---|---|
| 6 | 5 | 0.11 | 34.6 | 2.9 | >45 | 847 |
| 7 | 4.5 | 0.10 | 25.4 | 3.0 | >45 | 671 |
| 8 | 6 | 0.10 | 30 | 2.5 | >45 | 815 |

The results shown in Table 2 unexpectedly show that the method of the invention produced a novel web with surprising strength in the unbonded state and with excellent liquid barrier properties.

In still another example self bonded nonwoven webs were made from a meltblowing grade of Philips polypropylene resin in a modular die containing a single row of die holes. In this case the drawing air was provided from four converging-diverging supersonic nozzles per die hole. The converging-diverging supersonic nozzles were placed such that their axes were parallel to the axis of the die hole. The angle of convergence was 7° and the angle of divergence was 7°. The length of a side of the square spinneret holes was 0.025 inches and the polymer flow per hole was 0.2 grams/hole/minute at 250 psig. Air pressure was 15 psig. The fibers were collected on a collector cylinder capable of variable surface speed. A quench air stream was directed on to the collector. Fiber diameter and web strength were measured.

TABLE 3

| Trial Run | Air Pressure | Flow Rate | Basis Wt | Microns | Break Load |
|---|---|---|---|---|---|
| 9 | 15 | 0.25 | 15.3 | 12.1 | 548 |

The results shown in table 3 demonstrate that the method of the invention produced a novel web with surprising strength in the unbonded state and continuous fibers and a web appearance similar to spunbond material. Microscopic examination of the resultant webs showed excellent uniformity, no shot and no evidence of twinned fibers or fiber bundles and clumps due to turbulence.

In yet another example self bonded nonwoven webs were made from a meltblowing grade of Philips polypropylene resin in a modular die containing a single row of die holes. In this case the drawing air was provided from four converging-diverging supersonic nozzles per die hole. The converging-diverging supersonic nozzles were inclined at a 60° angle to the axis of the die hole. The length of a side of the square spinneret holes was 0.015 inches and the flow per hole was 0.11 grams/hole/minute at 125 psig. Air pressure of the air flow was 15 psig. The fibers were collected on a collector cylinder capable of variable surface speed. Fiber diameter and web strength were measured. These results are shown in Table 4.

TABLE 4

| Trial Run | Air Pressure | Flow Rate | Basis Wt | Microns | Break Load |
|---|---|---|---|---|---|
| 10 | 15 | 0.11 | 25.3 | 0.5 | 622 |

The results show that the method of the invention produced a novel web with surprisingly small diameter fibers, adequate strength in the unbonded state and a mix of continuous and discontinuous fibers. Microscopic examination of the resultant webs showed excellent uniformity and no evidence of twinned fibers or fiber bundles and clumps due to turbulence.

While the invention has been illustrated and described as embodied in an extrusion apparatus with modular die units which produces a unique web with properties of spunbond and meltblown, it is not intended to be limited to the details shown, since it will be understood that various omissions, modifications, substitutions and changes in the forms and details of the devices illustrated and in their operation can be made by those skilled in the art without departing in any way from the spirit of the present invention.

Without further analysis, the foregoing will so fully reveal the essence of the present invention that others can, by applying current knowledge, readily adapt it for various applications without omitting features that, from the standpoint of prior art, fairly constitute essential characteristics of the generic or specific aspects of this invention.

We claim:

1. A method for manufacturing a nonwoven web which comprises:

melting a polymer by polymer heating and extrusion means;

extruding said polymer at flow rates of less than 1 gram per minute per hole through the polymer orifices of one or more modular dies, each of said dies consisting of two or more spaced apart cross directional rows of polymer orifices, wherein the diameters of said polymer orifices of each individual row are constant diameter and wherein each successive row of said polymer orifices has a smaller diameter, said die being heated by a heating means; and blowing said polymer extrudate, using heated air of at least 200° F. or more, from 2 or more air jets per polymer orifice, wherein said air jets may have a constant or a variable cross-section, to produce essentially continuous polymer filaments wherein said continuous polymer filaments from each row on the die have different and increasingly smaller diameters than the preceding rows, and depositing said fiberized polymer on a collecting means to form a self bonded web consisting of as many layers of disbursed continuous polymer filaments as the number of rows in the die wherein each layer consists of filaments having a different and smaller diameter resulting in a filament size gradient through its depth.

2. The method of claim 1 wherein two or more polymer manifolds are used to supply different polymers to each of said polymer orifice rows.

3. The method of claim 1 wherein said fibers range from 0.1 microns to 5 microns.

4. The nonwoven web produced according to the method of claim 1 where the web is thermally bonded.

5. The method of claim 1, wherein said variable cross section air jet is a converging-diverging nozzle.

6. The method of claim 5 wherein the converging portion of said converging-diverging nozzle converges at an angle of no less than 2 degrees and no more than 18 degrees from the centerline of said nozzle; and the diverging portion of said nozzle diverges at an angle of no less than 3 degrees and no more than 18 degrees from the centerline of said nozzle.

7. The nonwoven fabric of claim 1 wherein said polymer is selected from the group consisting of olefins and their copolymers, styrenics and their copolymers, polyamides, polyesters and their copolymers, halogenated polymers, and thermoelastic polymers and their copolymers.

8. The nonwoven fabric produced according to the method of claim 1 where the web is a filtration material wherein the fibers of said web produced from each row of polymer orifices, which have progressively smaller diameters, are progressively smaller and range from 20 to 0.1 microns.

9. A method for manufacturing a nonwoven web which comprises:

melting a polymer by polymer heating and extrusion means;

extruding said polymer at flow rates of less than 1 gram per minute per hole through the polymer orifices of one or more modular dies, each of said dies consisting of two or more spaced apart cross directional rows of polymer orifices, wherein the diameters of said polymer orifices of each individual row are an equal and constant diameter and all rows have the same diameter polymer orifices, said die being heated by a heating means; and blowing said polymer extrudate, using heated air of at least 200° F. or more, from 2 or more air jets per polymer orifice, wherein said air jets may have a constant or a variable cross-section, to produce essentially continuous polymer filaments wherein said continuous polymer filaments from each row on the die are deposited on a collecting means to form a multi-layered self bonded web consisting of as many layers of disbursed continuous polymer filaments as the number of rows in the die.

10. The method of claim 9 wherein said variable cross section air jet is a converging-diverging nozzle.

11. The method of claim 10 wherein the converging portion of said converging-diverging nozzle converges at an angle of no less than 2 degrees from the centerline of said nozzle and no more than 18 degrees; and the diverging portion of said nozzle diverges at an angle of no less than 3 degrees and no more than 18 degrees from the centerline of said nozzle.

12. A low density insulation web produced according to the method of claim 9.

13. The nonwoven web produced according to the method of claim 9 wherein a layer of spunbond material is deposited on one or both sides of said web and the resultant laminate is bonded using a thermal calender.

14. The nonwoven web produced according to the method of claim 9 wherein said fibers range from 0.1 microns to 10 microns.

15. A method for manufacturing a nonwoven web which comprises:

melting a polymer by polymer heating and extrusion means;

extruding said polymer into filaments at flow rates of less than 1 gram per minute per hole through the polymer orifices of a one or more modular dies, each of said dies consisting of two or more spaced apart cross directional rows of polymer orifices, wherein the diameters of said polymer orifices of each individual row are an equal and constant diameter and all rows have the same diameter polymer orifices, said die being heated by a heating means; and blowing said polymer extrudate, using tempered air between 50° F. and 700° F. or more, from two or more two or more continuous converging-diverging nozzle slots, said nozzle slots being placed adjacent and essentially parallel to said polymer orifice exits wherein said continuous converging-diverging nozzle slots form a high speed air curtain on either side of, and essentially parallel to, the polymer extrudate, whereby said high speed air curtain attenuates said filaments and said continuous polymer filaments from each row on said die are deposited on a collecting means to form a multi-layered self bonded web consisting of as many layers of disbursed continuous polymer filaments as the number of said rows of polymer orifices in said die.

16. The method of claim 15 wherein said high speed air curtains may be separated from said high speed air curtains of any adjacent polymer orifice rows by plates positioned perpendicular to the surface of said modular die and parallel to said polymer orifice rows wherein said plates form a discrete channel for the drawing of said extrudate.

17. The nonwoven web produced according to the method of claim 15 where the web is thermally bonded.

18. The method of claim 15 wherein said high speed air curtain attenuates the continuous polymer filaments for the drawing of said extrudate.

19. The method of claim 15 wherein the converging portion of said converging-diverging nozzle converges at an angle of no less than 2 degrees from the centerline of said nozzle and no more than 18 degrees; and the diverging portion of said nozzle diverges at an angle of no less than 3 degrees and no more than 18 degrees from the centerline of said nozzle.

* * * * *